US005707300A

United States Patent [19]

May et al.

[11] Patent Number: 5,707,300

[45] Date of Patent: Jan. 13, 1998

[54] GOLF SWING TRAINING APPARATUS

[76] Inventors: Richard May, 2732 Altadena Rd., Birmingham, Ala. 35205; Ronald S. Stroud, 3502 Country Club Rd., Birmingham, Ala. 35213

[21] Appl. No.: 717,021

[22] Filed: Sep. 20, 1996

[51] Int. Cl.[6] ..... A63B 69/36

[52] U.S. Cl. ..... 473/257; 473/258; 473/272; 473/265; 473/269; 473/277

[58] Field of Search ..... 473/218, 257, 473/258, 270, 271, 272, 265, 266, 277, 269

[56] References Cited

U.S. PATENT DOCUMENTS

| | | | |
|---|---|---|---|
| 2,891,796 | 6/1959 | Cottrell . | |
| 4,651,994 | 3/1987 | Lee . | |
| 4,758,001 | 7/1988 | Otting . | |
| 4,993,716 | 2/1991 | Waller . | |
| 4,998,731 | 3/1991 | Bowen . | |
| 5,203,569 | 4/1993 | Rilling . | |
| 5,255,921 | 10/1993 | Spence . | |
| 5,334,028 | 8/1994 | Melligan . | |
| 5,634,858 | 6/1997 | Bellagamba | 473/257 |

*Primary Examiner*—George J. Marlo
*Attorney, Agent, or Firm*—Douglas C. Murdock

[57] ABSTRACT

A golf swing training apparatus designed to allow a golfer to practice full swing motions while actually hiring a golf ball. The device is light weight and of simple construction. It provides for optimization of practice time by allowing instant feedback as to progress, or the lack thereof, in the golfer's technique. The device monitors the lateral and forward leg and knee motion during the full swing motion. Moreover, the device provides swing plane indicator rods which may be positioned at any useful angle for a full range of golf swings.

4 Claims, 3 Drawing Sheets

GOLF SWING TRAINING APPARATUS

FIELD OF INVENTION

This invention relates to the sport of Golfing. In particular, the invention relates to devices which aid golfers in perfecting swinging a golf club.

BACKGROUND OF THE INVENTION

In the field of golf swing training aids, there are many examples of devices which tend to help golf sports enthusiasts improve their ability to manipulate a golf club. The present invention is a distinct improvement over prior golf swing aids in that it is not only a training aid designed to improve golfer stance and swing technique, it helps optimize practice time, and provides the user instant feedback as to the correctness or failure of the user's actual club swing motion. The instant device is very inexpensive, made of PVC piping or the like, and is collapsible such that it can be setup, used and collapsed again in seconds for easy transport. The device is adjustable for an individual golfer's knee height. Moreover, the apparatus can be adjusted for determination of a full range of swing angles such as driving, chips, pitches, sand shots and putting via swing plane indicators.

The prior art contains devices that individually address various aspects of golf swinging which have been recognized as susceptible to improvement through practice. For example, in U.S. Pat. No. 2891796 entitled GOLF TRAINING DEVICE, by W. R. Cottrell, a device is disclosed which particularly aids a golfer in his "follow-through" portion of a swing motion. Cottrell's device consists essentially of a vertical telescoping support with set vertical adjustments and includes a cross bar at the top of the telescoping element. The device is to be adjusted to hip height such that when a person swings, their arms will be kept forward of the plate, thereby forcing the player to adjust and improve the mechanics of his swing follow-through. The device is directed to control and movement of the upper body. In U.S. Pat. No. 4651994, entitled GOLF CLUB SWING TRAINING DEVICE, by E. W. Lee, an apparatus is disclosed which is primarily designed to assist a golfer in maintaining proper leg stance during the back swing portion of the golf swing. Particularly, Lee's device helps train the golfer to properly bend the knees and to not swing the legs laterally to the right (for right-handed persons) during the back swing. The device includes two vertical posts of which, for a right-handed person, the right post straps to the right calf, while the left post makes contact with the left leg. Both posts are intended to deter the legs from shifting left during the back swing.

Likewise in U.S. Pat. No. 4758001, entitled GOLF PRACTICE AIDS by B. Otting & S. Williams, a device is disclosed wherein the device is designed to teach the golfer not to shift legs rearward and to avoid swaying the hips during the back swing. This device is also bulky and difficult to break down. Moreover, it requires the physical attachment of the device to the user's hip and legs.

In other inventions, golf swing aids are designed to aid the golfer only in learning appropriate stance while addressing the ball such that after using the device, the golfer steps away and assumes the stance which the apparatus helps him learn. U.S. Pat. No. 4993716 entitled GOLF STANCE ALIGNMENT DEVICE, by M. Waller is such an example.

Still others claim to assist in teaching proper stance for various types of shots, but unlike the present invention the devices are either large and cumbersome to operate and/or not fully accessible to full swing while actually hitting a ball (U.S. Pat. No. 4998731 entitled GOLF PUTTING AND SWINGING AID FOR PRACTICE by J. Bowen).

Finally, other devices provide stance training while allowing the user to fully swing and engage the ball. However, these devices only provide for such points in interest as sensory leg and hip lateral movement (U.S. Pat. No. 5203569 GOLF STANCE TRAINER, J. Rilling); back swing, feet placement, and hip sway (U.S. Pat. No. 5225, 921, GOLF SWING TRAINING KIT, B. Spence); and in monitoring the relative backward motion of the golfer's legs by use of a force translation bar positioned behind the golfer's knees (5334028, GOLF SWING TRAINING PROCESS, E. Melligan).

The present invention provides for improvement over prior art in that the device is able to teach the golfer to avoid the key abnormal move that many golfers make causing inconsistency in swinging the golf club. When a golfer commences the back swing, (assuming a right-handed person) the left knee moves forward while the right knee maintains its flex and rotates slightly to the right. On the down swing the right knee maintains its flex and then should move parallel to the flight track and swing track of the ball and club. However, the error most golfers experience is allowing the right knee to move forward during the down swing rather than parallel to the flight track of the club/ball.

One object the invention is to guide the right knee along the proper parallel path during the downswing. Another embodiment of the invention is to give definite immediate negative feedback to the golfer if the right (trailing) knee is allowed to move forward. Such feedback is found in the disruption of the device's placement which will immediately foul the golfer's swing.

A further object of the invention is to encourage the upper body to remain bent over at the proper angle toward the ball which will occur by having the trailing knee follow a path parallel to the flight track as this movement discourages the golfer's body from raising upward.

Yet another embodiment of the invention are swing plane indicator rods mounted to the upper end of the device for positioning on either side of the golfer's body. The swing plane rods may be positioned along a plane relative to one another and at specific angles relative to the ground. The locator rods are adjustable and can be positioned parallel to one another or parallel to the lie angle of any club used. Thus, these indicator rods aid the golfer to maintain a consistent swing angle by forcing the golfer to swing along a plane parallel to and above the rods. A further object of the invention is to give golfers immediate negative feedback if the swing does not maintain the swing angle imposed by the locator rods in that the device position will be disrupted.

Another object of the invention are vertically spaced upper and lower parallel bars which train the golfer proper alignment of head, knees, and feet to the target ball for consistent reproducible practice. Alignment can be visually checked by comparing location of feet, knees, hips, shoulders relative to the parallel bars.

Another embodiment of the invention is the ability for the lower horizontal parallel bar to assist the golfer in practicing putting by acting as a guide for the putter. The present invent also provides for improvements over prior golf swing aids by providing an easily collapsible framework that is easy to set up and to transport. One embodiment of the invention is the use of PVC tubing that is lightweight and of small diameter.

SUMMARY OF THE INVENTION

The invention is a golf training aid designed to improve swing technique, to optimize practice time, and to provide instant feedback as to the progress of technique improvement. The apparatus comprises a lightweight adjustable frame made of PVC or other plastic material. The device comprises left and right base supports which lie generally on the outside of the user's feet. The left and right base supports connect by 90 degree elbow joints to left and right vertical supports. The left and right vertical supports are connected together by lower and upper parallel bars which are parallel to one another and the ground. The lower parallel bar is positioned to connect to each left and right vertical support above the base connection elbow joints such that there is sufficient space below the lower parallel bar for a golfer's shoe to slide between the bar and the ground. The upper parallel bar is connected to the upper ends of the left and right vertical supports. The height of the vertical supports is adjustable so that the upper parallel bar will stand about 19 to 21 inches tall. The height is to be adjustable to a height even with the golfer's knees while the golfer is in the proper address position.

The upper parallel bar extends outwardly beyond both the left and right vertical supports. Attached to the outer ends of the upper bar are left and right swing plane indicator rods. The rods attach at 90° angles to the upper and lower parallel bars and are 3 to 4 feet in length. The indicator rods may be attached by numerous means, preferably a 90° PVC elbow joint which can frictionally engage the outer extensions of the upper parallel bar. A golfer can adjust the rods to the lie angle of any particular golf club used. The lie angle is the angle of the golf club's shaft relative to the club head. Depending on the purpose of the club, e.g., to drive the ball a great distance or to putt a short distance, the angle of the shaft will be more or less acute from a 90° angle. Consequently, a golfer can adjust the swing plane indicators and commence practicing swinging, learning to keep his or her swing along the same plane indicated by the relative positioning of the rods.

The left and right base supports are connected to their respective left and right vertical supports such that the base supports are able to swivel about the vertical supports in a 360° arc. The advantage of this embodiment allows the easy folding of the apparatus for transport. Moreover, the bases may be adjusted inwardly or outwardly relative to the user's feet and/or to optimize the device's stability while configured in the general operating position. Likewise, the left and right swing plane indicator rods may rotate in a 360° arc about their respective connections to the upper parallel bar extensions. Like the base supports, the ability of the swing plane indicator rods to travel through a full 360 degree rotation allows easy collapse of the device for transport.

The manner of joining the base supports and the swing plane indicator rods to the vertical supports and upper parallel bar respectively may be by any number of means such as a PVC 90° elbow or ratchet type engagement wherein the elbow has small ridges comprising the inner circumference which engage similar ridges on the exterior circumference of the upper parallel bar extension ends.

It will be appreciated by those skilled in the art that the swing plane indicators are rods will experience downward gravitational force along their respective lengths. The connection between the upper parallel bar and the rods must therefore have the capacity to keep the indicator from falling. Therefore a preferred embodiment is the use of a ratchet type connector as shown in FIG. 6.

In use, the golfer stands with his or her feet partially under the lower horizontal bar such that either the toes or beginning of the shoelaces are even with the bar. Typically the base supports are parallel to one another and extend rearward and outside the feet on either side of the golfer. The golfer's knees are positioned about one-half inch behind the upper parallel bar. The swing plane indicator rods are positioned at the appropriate angle. From this stance, the golfer may commence normal swinging at golf balls. On the back swing the left knee is allowed to gently nudge the upper bar, while the right knee maintains its flex slightly to the right. On the down swing, the right knee maintains its flex and then moves left parallel to the upper bar without touching it. The device guides the right knee along the proper parallel path and gives definite immediate feedback if the right knee's move is wrong. When the right knee moves parallel left, the upper body is encouraged to remain bent over toward the ball and discourages raising up. By repeated observation and use of the relative positions of the upper and lower parallel bars and the swing plane indicator rods, the golfer will learn to maintain proper swing positioning.

When the improper forward movement of the knees occurs, the apparatus may easily tip forward and cause the swing to be fouled. Likewise, improper back swing and down swing in relation to the swing plane indicator rods is likely to disturb the apparatus's position, thereby providing instantaneous negative feedback to the user.

Another embodiment of the invention incorporates the use of the left swing plane indicator rod as a left lateral slide limiter. In other words, the device may be useful to teach the golfer to avoid swaying the hips too much to the left instead of properly rotating the hips through the swing. By placing the left foot to the left or outside the left base support, the left hip will be positioned in close proximity (within 1 inch) of the left swing plane indicator. Proper hip rotation is indicated when the golfer avoids bumping the indicator rod.

Yet another embodiment of the invention is the use of the left base support as a positioner for placement of the ball. As with using the left swing plane indicator rod for monitoring hip movement, the golfer stands with the left foot to the left (outside) the base support such that the golfer's left heel is placed an appropriate distance from the position of the base support. The ball is positioned in front of the left base support as shown in FIG. **4*b***.

BRIEF DESCRIPTION OF THE DRAWINGS

The foregoing and other objects or features and advantages of the present invention will be made apparent from the following detailed description of the preferred embodiments of the invention and from the drawings in which.

FIG. **4*a*** is a perspective view taken from the rearward direction showing a second possible stance with the user's left foot positioned to the left of the left base support.

FIG. **4*b*** is a schematic top view showing feet position and ball position placement for one embodiment of the invention.

FIG. **5*a*** is a sectional exploded view of the elbow connection between a base support and a vertical support.

FIG. **5*b*** is a sectional exploded view of the elbow connection between a swing indicator rod and an upper parallel bar extension.

Figure 1:
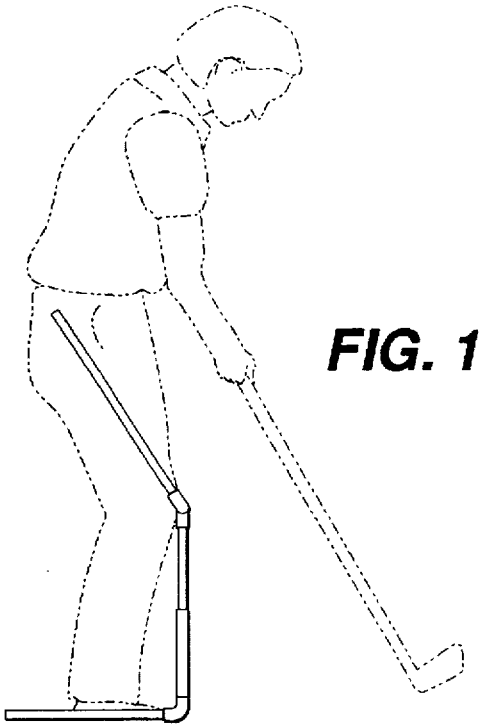
FIG. 1 is a lateral elevation from the right side of the device showing a typical stance of the Golfer.
Figure 2:
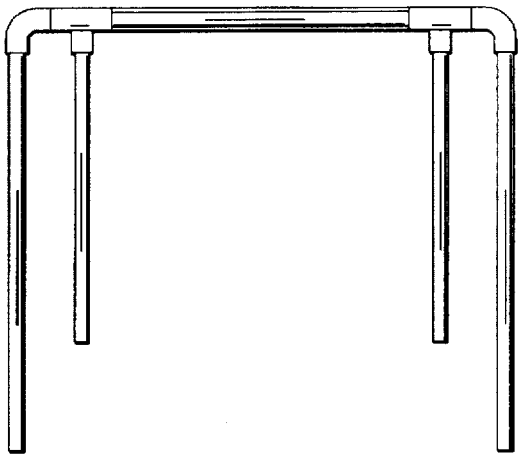
FIG. 2 is a plan view of the apparatus.
Figure 3:
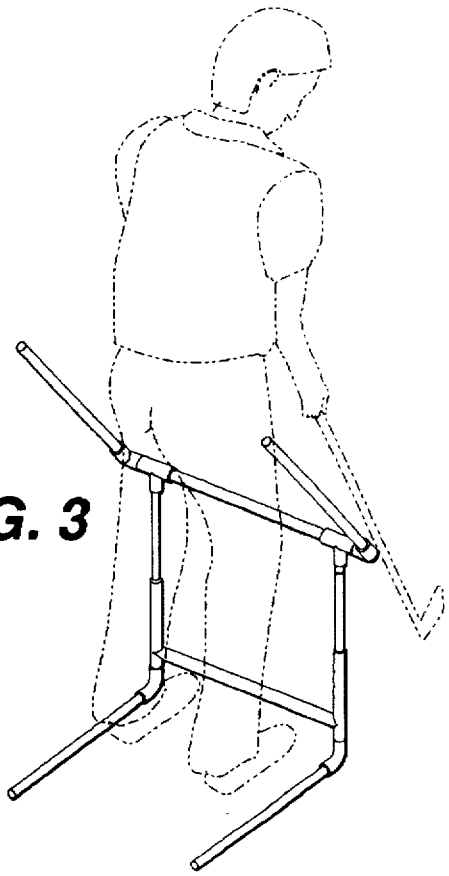
FIG. 3 is a perspective view taken from the rearward direction showing the typical stance of the user.
Figure 4A:
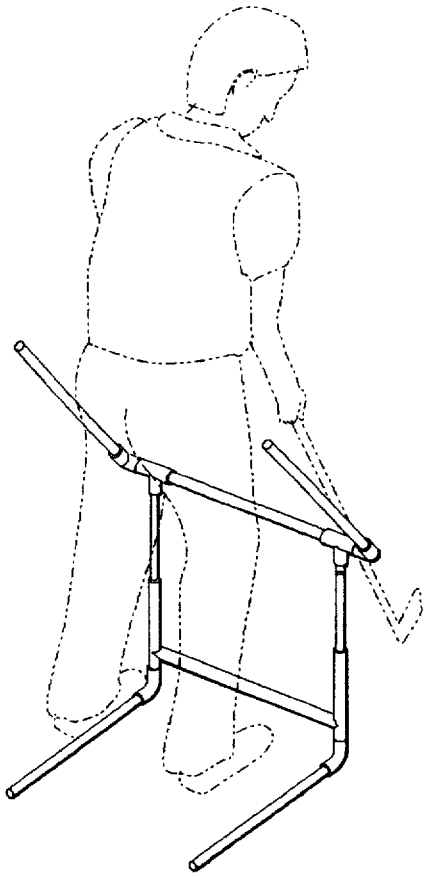
Figure 4B:
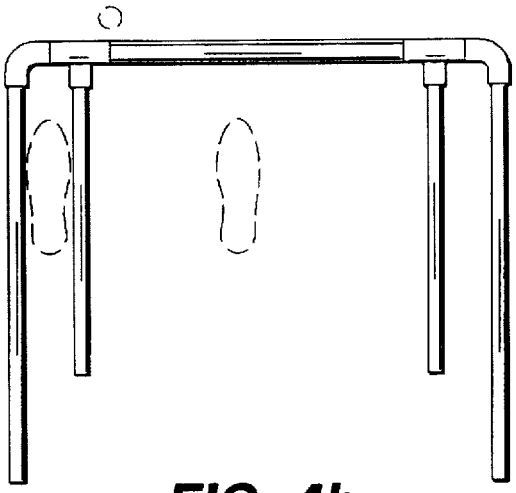
Figure 5A:
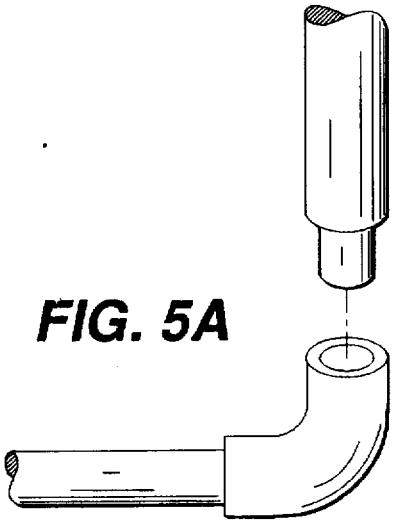
Figure 5B:
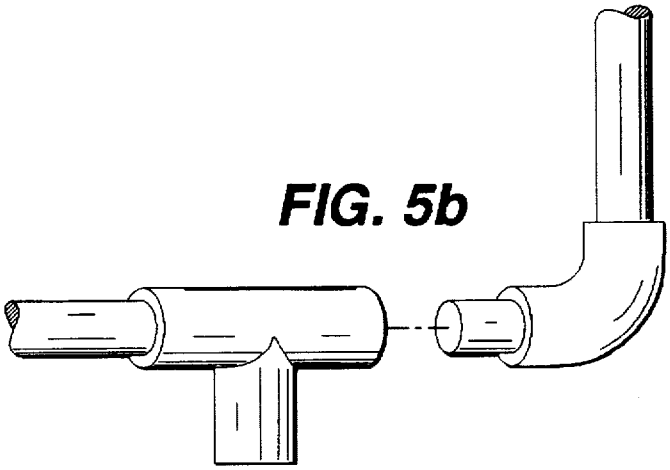
Figure 6:
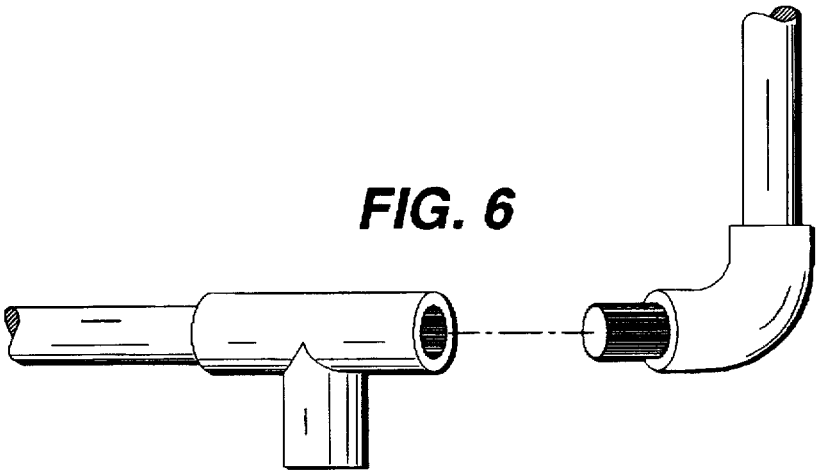

FIG. 6 is a sectional exploded view of one embodiment of the connector between the swing indicator elbow joint and the upper parallel extension showing a ratchet-type connector.

Figure 7:
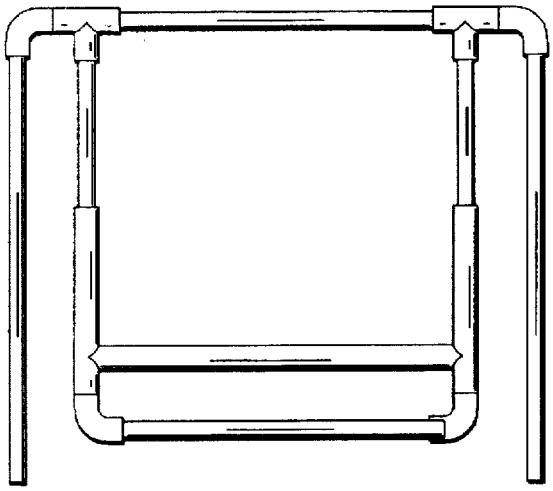

FIG. 7 is a perspective view of the device in a collapsed configuration.

Figure 8:
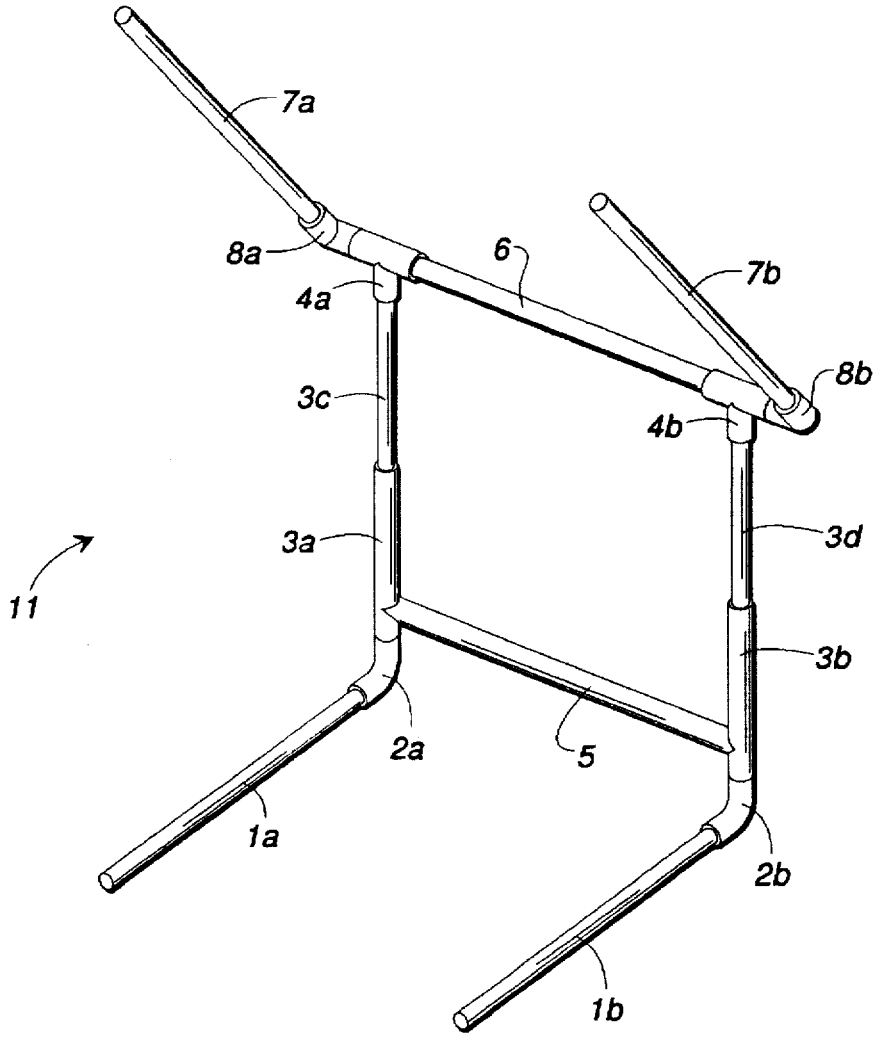

FIG. 8 is a perspective detailed view of the invention looking from the rear of the apparatus.

DETAILED DESCRIPTION OF THE INVENTION

Referring to FIG. 8, golf swing training apparatus 11 consists generally of a plastic or composite material tubing. There are two base supports 1*a* and 1*b* which lie on the ground and are connected respectively to elbow joints 2*a* and 2*b*. The upper ends of elbow joints 2*a* and 2*b* are connected to vertical supports 3*a* and 3*b* respectively.

The attachment of elbow joints 2*a* and 2*b* to their respective vertical supports 3*a* and 3*b* is such that the base supports may freely swing about the axis made along the length of vertical supports 3*a* and 3*b*. In other words, elbow joints 2*a* and 2*b* are permanently secured in a fixed position relative to base support 1*a* and 1*b* respectively but are secured to vertical supports 3*a* and 3*b* such that the base supports are free to move.

The freedom of movement allows base supports 1*a* and 1*b* to be positioned in any direction desired by the user. Moreover, the ability for free rotation allows the base supports to be turned in toward one another to a parallel position allowing the apparatus to be collapsed in a single plane.

Connected to the lower ends of vertical supports 3*a* and 3*b* is lower parallel bar 5. Lower parallel bar 5 is not only functional in a structural support but is also a lateral spacer creating a length of spacing between vertical supports. Moreover the lower parallel bar can be used as a putting guide as well as a foot placement guide.

Connected to vertical supports 3*a* and 3*b* are slidably engaged vertical supports 3*c* and 3*d* respectively. One object of the invention includes adjustable vertical support means such that the height of the vertical supports may be raised or lowered as desired by the user. In a preferred embodiment the adjustability of the height is carried out by telescoping means wherein vertical support 3*c* telescopes into vertical support 3*a* and likewise 3*d* into 3*b*. In a related preferred embodiment the maintenance of the adjustments is by frictional engagement of a tight fit between supports 3*c* and 3*d* and their respective vertical supports 3*a* and 3*b*.

Connected to the upper ends of supports 3*c* and 3*d* are support means 4*a* and 4*b* by which upper parallel bar 6 is connected between 4*a* and 4*b*. It is contemplated that the length of bar 6 will be essentially equal to the length of bar 5. Bar 6 is useful for determining the proper positioning of the golfer's knees. The upper bar also serves to provide visual adjustment of the proper positioning of the golfer's head such that the golfer may find a line of sight down across the upper and lower parallel bars.

On the outer ends of support means 4*a* and 4*b* swing plane indicator rods 7*a* and 7*b* are joined via connector elbow joints 8*a* and 8*b* respectively. Connector joints 8*a* and 8*b* function to hold the swing plane indicator rods 7*a* and 7*b* via frictional engagement to means 4*a* and 4*b*. An object of the invention is the ability to raise or lower the angle of the swing plane rods 7*a* and 7*b* by means of rotating the elbow joints 8*a* and 8*b* about the horizontal axis of support means 4*a* and 4*b*. It will be appreciated that in order for such ability to rotate and maintain position, the elbow joints 8*a* and 8*b* must not be fixed to support means 4*a* and 4*b* in a permanent position. Moreover a preferred embodiment of the invention includes elbows 8*a* and 8*b* being frictionally engaged to support means 4*a* and 4*b* by either a tight fit or by means of a ratchet engagement according to FIG. 6.

While the preferred embodiment of the present invention is shown and described, it is envisioned that those skilled in the art may devise various modifications of the present invention without departing from the spirit and scope of the claims. The invention is not intended to be limited by the foregoing disclosure, but only by the following appended claims:

I claim:

1. A golf swing training apparatus comprising:

a) first and second spaced horizontal base supports;

b) first and second spaced vertical supports having top and bottom ends, said bottom ends of said vertical supports connected to said first and second spaced horizontal base supports respectively by first and second elbow joint means, said first and second elbow joint means each having the capacity to swivel about an axis along the length of each left and right vertical supports, said vertical supports further possessing the ability to adjust in length;

c) spaced upper and lower horizontal alignment bars, said alignment bars each having left and right ends, said lower alignment bar connected by its respective left and right ends to said first and second vertical supports above said elbow joint means, said upper alignment bar connected respectively near its left and right ends to said top ends of said first and second vertical supports;

d)first and second adjustable swing plane indicator rod L-joints; and e) first and second swing plane indicator rods, each of said swing plane indicator rods having a length of about 3 to 4 feet, each of said swing plane indicator rods further having a first end, said first end of said first swing plane indicator rod connected to said first adjustable swing plane indicator rod L-joint, said first end of said second swing plane indicator rod connected to said second adjustable swing plane indicator rod L-joint, said first and second adjustable swing plane indicator rod L-joints further connected respectively to said left and right ends of said upper alignment bar, said L-joints further having the capacity to swivel about an axis along the length of said upper alignment bar.

2. A golf swing training apparatus according to claim 1 wherein said vertical supports are adjustable by telescoping means.

3. A golf swing training apparatus according to claim 2 wherein the apparatus is constructed of materials from the group consisting of PVC tubing, plastic, fiberglass, and carbon fiber composite.

4. A golf swing training apparatus according to claim 3 wherein said swing plane indicator rod L-joints are connected to said left and right ends of upper alignment bar by ratchet type frictional engagement.

* * * * *